US006923347B2

(12) United States Patent
Winckels

(10) Patent No.: US 6,923,347 B2
(45) Date of Patent: Aug. 2, 2005

(54) ASSEMBLY FOR PACKAGING A PRODUCT, ESPECIALLY A COSMETIC PRODUCT

(75) Inventor: Mathilde Winckels, Clichy (FR)

(73) Assignee: L'Oreal, Paris (FR)

( * ) Notice: Subject to any disclaimer, the term of this patent is extended or adjusted under 35 U.S.C. 154(b) by 183 days.

(21) Appl. No.: 10/388,523

(22) Filed: Mar. 17, 2003

(65) Prior Publication Data

US 2003/0209566 A1 Nov. 13, 2003

(30) Foreign Application Priority Data

Mar. 15, 2002 (FR) ..... 02 03263

(51) Int. Cl.[7] ..... B65D 37/00

(52) U.S. Cl. ..... 222/206; 222/131; 222/215; 206/581; 206/229; 206/823; 220/495.01; 220/23.83; 220/23.91

(58) Field of Search ..... 222/206, 212, 222/215, 130, 131, 183; 206/216, 223, 581, 229, 446, 485, 485.1, 823; 220/495.01, 23.83, 23.87, 23.91

(56) References Cited

U.S. PATENT DOCUMENTS

| | | | | |
|---|---|---|---|---|
| 2,752,251 A | | 6/1956 | Peters | |
| 3,156,279 A | * | 11/1964 | Grebowiec et al. | 215/12.1 |
| 3,311,248 A | | 3/1967 | Marchant | |
| 4,324,348 A | * | 4/1982 | Johnson et al. | 222/181.2 |
| 4,456,134 A | | 6/1984 | Cooper | |
| 4,798,311 A | | 1/1989 | Workum | |
| 5,299,700 A | * | 4/1994 | Beniacar | 215/12.1 |
| 5,765,708 A | * | 6/1998 | Fragos | 220/8 |
| 5,901,882 A | * | 5/1999 | Siegel | 222/131 |

FOREIGN PATENT DOCUMENTS

| | | |
|---|---|---|
| FR | 1570600 | 6/1969 |
| WO | WO 00/18650 | 4/2000 |

OTHER PUBLICATIONS

U.S. Appl. No. 10/373,016, filed Feb. 26, 2003, Winckels.

* cited by examiner

*Primary Examiner*—Michael Mar
*Assistant Examiner*—Patrick Buechner
(74) *Attorney, Agent, or Firm*—Oblon, Spivak, McClelland, Maier & Neustadt, P.C.

(57) ABSTRACT

An assembly for packaging a product such as a cosmetic product in the form of a cream or a gel. The assembly includes a flexible container or pot containing the product, with the container having a first end closed by a bottom and a second end, opposite the first, forming a neck delimiting an opening. The flexible container is removably disposed in a rigid structure with the rigid structure preferably extending substantially over the entire height of the container lying under the neck. The flexible container is configured so that, once it is extracted from the rigid structure, pressure exerted on the flexible container causes deformation of the container to displace the product towards the opening for use. The container can return to its undeformed shape by elastic return forces when the pressure ceases.

50 Claims, 2 Drawing Sheets

ASSEMBLY FOR PACKAGING A PRODUCT, ESPECIALLY A COSMETIC PRODUCT

CROSS REFERENCE TO RELATED APPLICATIONS:

This document claims priority to French application number 0203263 filed Mar. 15, 2002, the entire content of which is hereby incorporated by reference.

BACKGROUND OF THE INVENTION

1. Field of the Invention

The present invention relates to an assembly for packaging products. The assembly can be particularly advantageous for packaging cosmetic products in the form of a gel or a cream.

2. Discussion of Background

The present invention is particularly advantageous in facilitating dispensing of the contents of a container, e.g., in the form of a pot or jar like container. Typically, in the field of cosmetic products, the user inserts her fingers into a container to remove some of the contents. Obviously, this operation becomes increasingly difficult when approaching the bottom of the container, particularly for containers having a small cross section relative to their height.

Containers equipped with plunger or bellows systems are known. These arrangements are configured so as to deliver a dose of the product contained inside the container in response to pressure exerted on the container bottom, or in response to rotation of an operating component. For example, French Patent FR 1 570 600 describes a device having an outer packaging and an inner packaging, in the form of bellows, fitted on a plunger. The plunger is displaced upwards, so as to compress the bellows as the number of uses increases and to cause delivery of the product, either by manually pressing directly on the bottom or by rotating the outer packaging with respect to a dispensing device secured to the inner packaging. Such a mechanism is complicated, and the cost of the container is therefore high and incompatible with the economic constraints of the retail industry.

U.S. Pat. No. 4,456,134 describes another packaging system, in which the volume of a container is adjusted by using a flexible part, for example, a bellows type arrangement. The height of the container can be reduced by screwing two cylindrical parts forming the outer package onto one another. The visible height of the container is thereby commensurately reduced. As with the device discussed above, this system is complicated and expensive.

SUMMARY OF THE INVENTION

It is, therefore, an object of the invention to provide an assembly in the form of a package or container, e.g., in the form of ajar or pot type container, in which the contents can be easily dispensed and which solves all or some of the problems discussed above.

It is a further object of the invention to provide such a container which is economical to produce and simple to use.

It is another object of the invention to provide a container or pot in which the same hand movements can be used for removing some of the product, e.g., using a finger, and in which the ease of dispensing does not substantially deteriorate as the number of dispensing operations increases.

Other objects will also become apparent from the following detailed description. The invention provides an assembly in the form of a container or package for a product, such as a cosmetic product in the form of a cream or a gel, to achieve some or all of the above objectives. The assembly includes a flexible container, e.g., a pot containing the product, with the container having a first end closed by a bottom and a second end, opposite the first, forming a neck delimiting an opening. The flexible container is removably fitted inside of a rigid structure, with the rigid structure preferably extending substantially over the entire height lying under the neck of the flexible container. In addition, the flexible container is configured so that, once it is extracted from the rigid structure, pressure exerted on the flexible container causes deformation of the latter to displace the product towards the opening. The container can then return to its undeformed shape by elastic return forces when the pressure ceases.

The term "rigid structure" is intended to mean a structure which, in response to an axial stress, presents a resistance which is greater than the resistance presented by the flexible container in response to the same axial stress.

Preferably, the material forming the rigid structure has a Shore hardness which is greater than the Shore hardness of the material forming the flexible pot. Thus, due to the presence of the rigid structure, the assembly is sufficiently stable when it is arranged on a display stand or during storage, in particular when it is stacked.

During use, the consumer extracts the container or pot from the rigid structure. This operation is facilitated by the fact that at least a part of the neck, and optionally of the lid which covers the container opening, lies above the rigid structure. Preferably, all of the neck lies above the rigid structure, with an upper edge of the rigid structure lying substantially level with the container shoulder formed at the base of the neck.

After the opening of the container has been uncovered, the user exerts pressure on the walls of the container, so as to force the product towards the opening. It is then easy to remove some of the product, in particular by using a finger or any other application device. The product is then applied in the conventional way.

When the pressure on the walls of the container ceases, the remaining product descends back towards the bottom of the container, and the opening can be re-closed until the next time the assembly is used.

Alternatively, in the case where a composition of two or more components is to be used, such as dying hair by extemporaneously mixing a dye and an oxidizing agent, one of the products or components can be provided in the form of a cream packaged in the flexible container. The other product, e.g., the dye, is packaged separately, such as in a compartment formed in the bottom of the rigid structure, so that it is kept isolated from the flexible container by a removable film. By way of example, the film is preferably made of an aluminum-based complex or laminate.

During use, the consumer extracts the flexible container from the rigid structure. The user then takes off the removable film that seals the compartment which is formed in the bottom of the rigid structure, and which contains the dye. The user uncovers the opening of the flexible container and presses its contents into the rigid structure. Everything can then be mixed together by using a suitable tool so as to homogenize the dye composition, and the user can then apply the composition in the conventional way, e.g., in the form of streaks.

In accordance with one preferable form of the invention, the rigid structure is removably fastened on the flexible container by a mechanical attachment, such as by snap-fastening, screwing or a bayonet mount system. Preferably, this removable fastening is made possible by the presence of regions of the container which are thicker and therefore more rigid, at the places where the attachment is to take place. Such regions of increased thickness are preferably provided level with the bottom of the pot.

The neck of the container can also have a larger thickness, to allow the attachment of a stopper, such as a screw-in or screw-on top. To that end, preferably an outer surface of the neck has a screw thread which can interact with a corresponding screw thread provided on the inner surface of a stopper. Other means for fastening the lid on the container or pot may be provided. For example, the attachment can be provided by a snap-fastening or by a ramped system.

As with the rigid structure, the lid is preferably also made of a rigid material. In practice, it is possible to use the same materials or different materials for the rigid structure and the lid.

Advantageously, a part of the lid is substantially in contact with a corresponding part of the rigid structure when the lid is fitted in position on the container or pot. The container can thus be stacked without any risk of crushing. According to a preferred example, the lid has an annular edge which is substantially in contact with an annular portion of the rigid structure, in particular the upper edge of the rigid structure, when the lid is fitted in position on the container.

Preferably, the flexible container or pot includes an attachment arrangement in the vicinity of its bottom, for example, in the form of ribs or tabs, which can reversibly interact with a complementary attachment arrangement provided in the vicinity of the bottom of the rigid structure to couple the container and the rigid structure.

Preferably, the rigid structure can be advantageously fitted/separated relative to the flexible container in response to the rotation of one relative to the other. The direction in which the rigid structure is moved in rotation relative to the container during separation may be the same as the direction in which the stopper of the container is unscrewed. Alternatively, the rotation direction for separation can be the opposite of the direction in which the stopper or lid of the container is rotated to unscrew it.

The flexible container may be produced by injection-blow molding. Preferred examples of suitable materials include an elastomeric material or a polyolefin, more preferably a polyethylene or a polypropylene, obtained by metallocene catalysis and optionally mixed with another polyolefin. Specific examples of materials include a material (metallocene polyethylene) marketed under the brand name EXACT™ by the company DSM, or alternatively, a material (metallocene polypropylene) marketed under the brand name Metocene™ by the company TARGOR.

It is also possible to use a material which is formed by a mixture of a polyolefin obtained by metallocene catalysis and a traditional polyolefin. Such a material or mixture of materials can be advantageous in order to control the flexibility of the material independently of the thickness of the walls.

When an injection-blow molding process is used, variation of the thicknesses of the wall of the body can be achieved by controlling the thicknesses of the preform and the diameter variations of the body of the flexible container. More specifically, the perform preferably has a larger or increased thickness at a location level with the neck or at a location from which the neck extends, and also at a level of or in the vicinity of the bottom. In this way, during blow molding, the diameter variations between the base of the neck and the shoulder formed between the neck and the side wall of the container will cause the wall to become thinner towards the largest diameter of the container. The neck will, therefore, be thicker than the shoulder and than the side wall of the container.

Purely as an example and not to be construed as limiting, the thickness may be of the order of 1.5 mm level with the neck. The thickness can decrease progressively over the shoulder towards the side wall of the body of the container, e.g., with the average thickness of the side wall on the order of from 0.7 mm to 0.8 mm. The thickness of the bottom may be of the same order as the thickness of the wall of the neck.

Also by way of example, the rigid structure may be made of a thermoplastic material, preferably polypropylene or polyethylene, and it may be obtained, for example, by injection molding. Alternatively, the rigid structure can be formed of a material that includes a metal, e.g., aluminum, or glass.

The assembly according to the invention can advantageously be used for packaging and optionally preparing a cosmetic product, especially a product for hairdressing, a hair dye, a skin care product or a scalp treatment.

BRIEF DESCRIPTION OF THE DRAWINGS

A better appreciation of the invention and many of the attendant advantages thereof will become further apparent from the following detailed description, particularly when read in conjunction with the accompanying drawings in which.

DETAILED DESCRIPTION OF THE PREFERRED EMBODIMENTS

Figure 1:
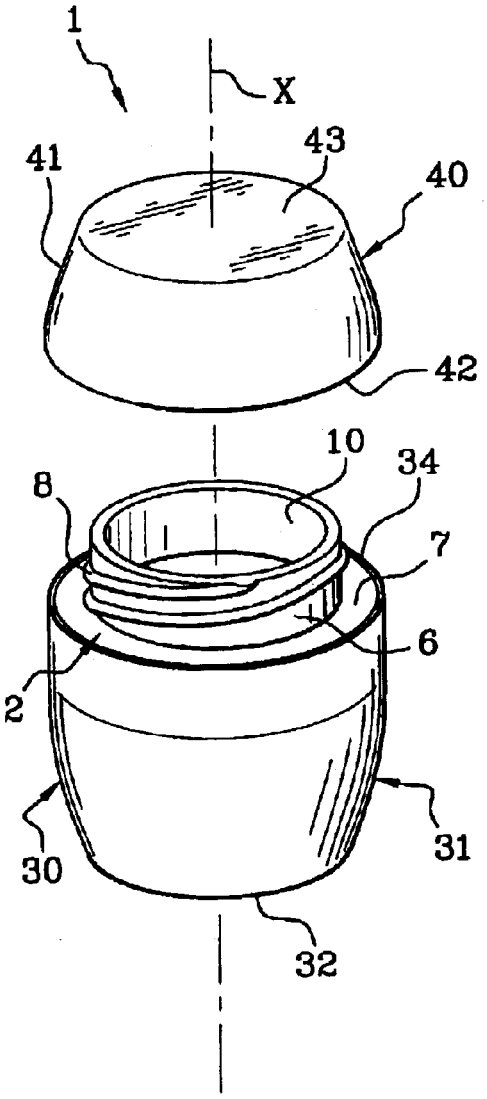
FIG. 1 is an assembled view of an assembly according to a preferred embodiment of the invention.
Figure 2:
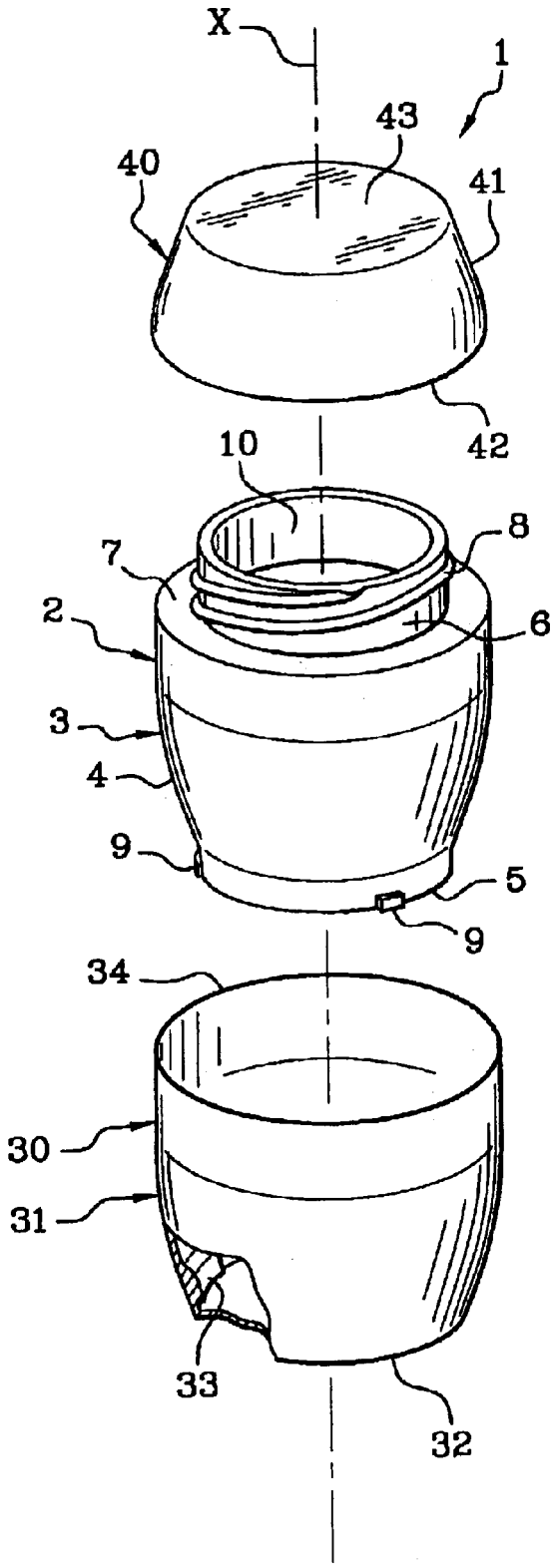
FIG. 2 is a view of the assembly in FIG. 1, in the separated position.
Figure 3:
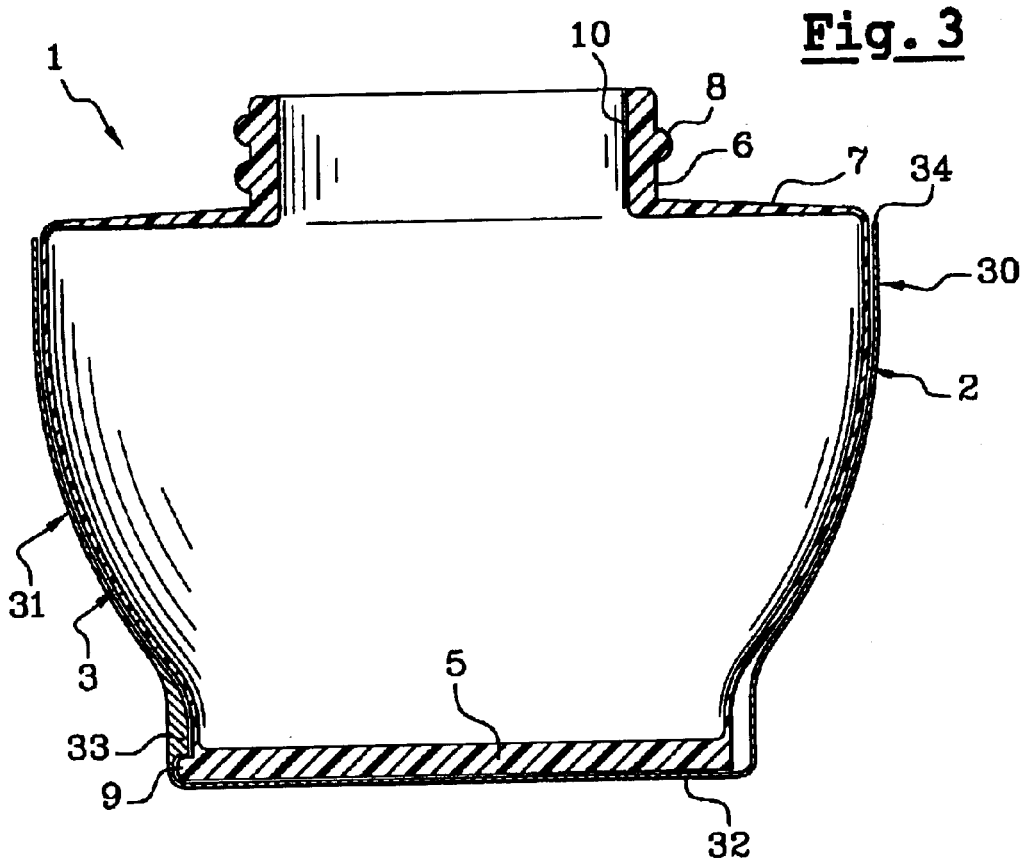
FIG. 3 is a view in longitudinal section of the assembly in FIG. 1.

The assembly 1 represented in FIGS. 1–3 includes a flexible container or pot 2, a rigid casing 30 and a stopper 40. In the illustrated embodiment, the assembly 1 has a longitudinal axis X. The flexible container of the illustrated example is made by injection-blow molding from a material marketed under the brand name Exact™ by the company DSM, however, other materials could be used.

The container includes a body 3 delimited by a side wall 4 whose diameter preferably decreases progressively towards a closed bottom 5. The other end of the container terminates in a neck 6, which is connected to the side wall by a transverse shoulder 7. A free edge of the neck 6 delimits an opening 10. In the illustrated embodiment, the outer surface of the neck 6 includes a screw thread 8 which can interact with a screw thread provided on an inner surface of the stopper 40.

As can be seen from the sectional view in FIG. 3, the bottom 5 and the neck 6 have a thickness larger than the thickness of the side wall 4 and of the transverse shoulder 7. The extra or increased thickness of the neck makes it possible to ensure a good screw attachment between the lid 40 and the body 3. The increased thickness of the bottom 5 is preferred to stabilize the container when it is placed on a flat surface. It furthermore promotes reversible attachment between the flexible container 2 and the rigid structure 30, which is described below.

In the example shown, the outer peripheral surface of the bottom of the container has three portions with ribs 9, which are spaced apart by 120° and which provide a reversible attachment between the rigid structure 30 and the container or pot 2.

The rigid structure 30 can be made, for example, by injection molding from polypropylene. As shown, the rigid structure includes a side wall 31 having a profile similar to the outer profile of the side wall 4 of the flexible container 2. Its inner cross section, however, is slightly larger than that of the flexible container, so that the latter can be inserted into the rigid structure with a slight clearance.

One end of the side wall 31 is closed by a bottom 32. A closed bottom, however, is not required.

In the vicinity of the bottom 32 of the rigid structure, and on its inner surface, the side wall 31 has three portions 33 protruding from the inner surface of the lateral skirt 31. The portions 33 are spaced apart by 120° and are intended to interact with the ribs 9 provided on the bottom of the container 2, so as to permit reversible attachment of the rigid structure 30 on the container 2.

With the illustrated example, the ribs 9 engage with the attachment portions 33 of the rigid structure by rotating the rigid structure 30 through a few degrees relative to the flexible container 2.

The other end of the side wall 31 of the rigid structure 30 is open and terminates in a free edge 34. The inner cross section is slightly larger than the outer cross section of the shoulder 7 of the flexible pot 2.

In the assembled position, and as can be seen more clearly from the sectional view in FIG. 3, the open end of the rigid structure 30 is substantially level with the peripheral edge of the shoulder 7.

Although not shown, it is also possible for the upper edge of the side wall 4 of the flexible pot 2 to be set back slightly from the peripheral edge of the shoulder 7 of the pot, by an amount corresponding substantially to the thickness of the upper edge of the rigid structure 30, so that the peripheral edge of the shoulder 7 of the flexible pot 2 bears on the upper edge of the rigid structure 30.

The lid 40 includes a lateral skirt 41 whose cross section increases progressively towards a free edge 42. The other end of the skirt 41 is closed by a transverse wall 43. In the preferred example, the lid is made of a material which is the same as that of the rigid structure 30, however, different materials could also be used.

The cross-section of the free edge 42 of the lid 40 is substantially equal to the cross section of the upper edge 34 of the rigid structure 30, so that the lid 40 substantially abuts against the rigid structure 30 in the assembled position. In order to use the assembly according to the invention, the user turns the rigid structure 30 relative to the container or pot 2, while holding the latter by the lid 40, until the components are relatively rotated by an angular amount sufficient for the tabs 9 to disengage from the projections 33 formed on the inner surface of the rigid structure 30. After the tabs 9 have been disengaged, the user extracts the flexible pot 2 from the rigid structure 30. The lid 40 is then unscrewed.

Figure 4:
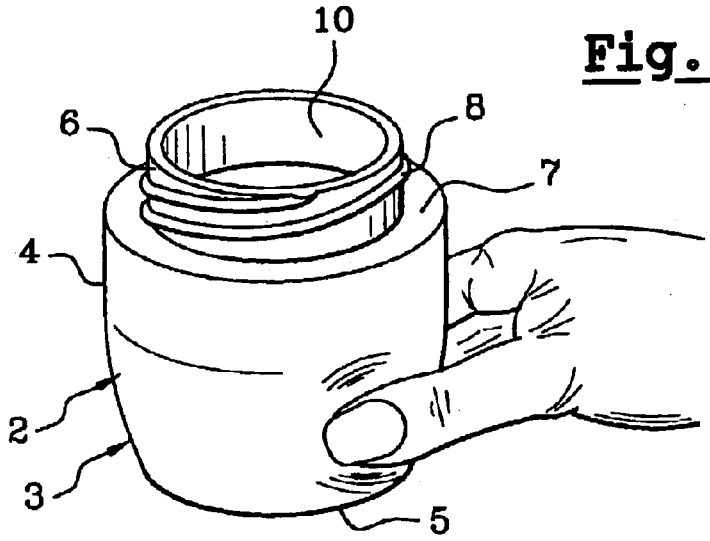
FIG. 4 illustrates the use of the flexible container or pot represented in FIGS. 1–3.

Subsequently, as shown by FIG. 4, the user exerts a pressure on the side wall 4 of the container 2. In this way, the cross section of the container is reduced and the product is forced towards the opening 10, so that some of the product can be easily removed by using a finger or other utensil or applicator.

When the user releases the pressure exerted on the container 2, the container returns to its original shape, hence causing the product remaining in the container to return towards the bottom 5.

After having used some of the contents of the pot 2, the user replaces the lid 40 and puts the container 2 away, either independently of the rigid shell 30 or by replacing it inside the latter, until it needs to be used again.

Obviously, numerous modifications and variations of the present invention are possible in light of the above teachings. It is therefore to be understood that, within the scope of the appended claims, the invention may be practiced otherwise than as specifically described herein.

What is claimed is:

1. An assembly for packaging a product comprising:

(a) a flexible container which contains the product, the container having a first end closed by a bottom and a second end, opposite the first, forming a neck delimiting an opening;

(b) a rigid structure inside of which the flexible container is removably fitted, wherein when the flexible container is disposed in the rigid structure, the rigid structure extends substantially over an entire height under the neck of the flexible container;

wherein the flexible container is configured such that the flexible container is extracted from the rigid structure to dispense the product, and wherein when the flexible container is extracted, a pressure exerted on the flexible container causes deformation of the flexible container and displaces the product towards said opening, and wherein the flexible container returns to a substantially undeformed shape by elastic return forces when said pressure ceases and the flexible container is configured to be returned into said rigid structure after dispensing of the product.

2. An assembly according to claim 1, wherein at least one part of the neck lies above the rigid structure.

3. An assembly according to claim 1, wherein the rigid structure is removably fastened on the flexible container by a mechanical attachment.

4. An assembly according to claim 3, wherein the mechanical attachment includes at least one of a snap-fastening, a screw attachment, and a bayonet mount.

5. An assembly according to claim 1, wherein the flexible container comprises attachment means in the vicinity of the bottom which can reversibly couple with complementary attachment means provided in the vicinity of a bottom of the rigid structure.

6. An assembly according to claim 1, wherein the container includes regions of increased thickness as compared with other regions of said container.

7. An assembly according to claim 6, wherein said regions of increased thickness include said neck.

8. An assembly according to claim 6, wherein said regions of increased thickness include a portion of said container from which said neck extends.

9. An assembly according to claim 1, further including a lid to close said opening, wherein an outer surface of the neck has a screw thread which can interact with a corresponding screw thread provided on an inner surface of the lid.

10. An assembly according to claim 1, wherein the flexible container is an injection-blow molded container.

11. An assembly according to claim 10, wherein the container is formed of an elastomeric material.

12. An assembly according to claim 10, wherein the container is formed of a material including a polyolefin.

13. An assembly according to claim 10, wherein the container includes a polyethylene material formed by metallocen catalysis.

14. An assembly according to claim 13, wherein said polyethylene material is mixed with another material, and wherein said another material is a polyolefin.

15. An assembly according to claim 10, wherein the container includes a polypropylene material formed by metallocen catalysis.

16. An assembly according to claim 15, wherein said polypropylene material is mixed with another material, and wherein said another material is a polyolefin.

17. An assembly according to claim 1, wherein the rigid structure is formed of a thermoplastic material.

18. An assembly according to claim 1, wherein the rigid structure is formed of a material including at least one of a polypropylene material and a polyethylene material.

19. An assembly according to claim 1, wherein the rigid structure is at least partially formed of aluminum.

20. An assembly according to claim 1, wherein the rigid structure is at least partially formed of a metal.

21. An assembly according to claim 1, wherein the rigid structure is at least partially formed of glass.

22. An assembly according to claim 1, wherein the product contained in said container is a cosmetic product.

23. An assembly according to claim 1, wherein the product contained in said container is a hair product.

24. An assembly according to claim 1, wherein the product contained in said container is at least one component of a hair dye product.

25. An assembly according to claim 1, wherein the product contained in said container is a skin care product.

26. An assembly according to claim 1, wherein the product contained in said container is a scalp treatment.

27. An assembly according to claim 1, further including a lid removably coupled to said neck.

28. An assembly according to claim 27, wherein said neck of said container has a diameter substantially smaller than a diameter at a side wall portion of said container, and wherein said lid includes a skirt having a diameter at least as large as the diameter at said side wall portion.

29. An assembly according to claim 28, wherein said lid is formed of a rigid material.

30. An assembly according to claim 29, wherein an outer portion of said skirt is adjacent to said rigid structure when said lid is mounted on said neck and said container is disposed in said rigid structure.

31. An assembly according to claim 30, wherein said container includes a side wall having a contour which is the same as a contour of a side wall of said rigid structure.

32. An assembly according to claim 1, wherein said container includes a side wall having a contour which is the same as a contour of a side wall of said rigid structure.

33. An assembly for packaging a product comprising:

(a) a flexible container which contains the product, the container having a first end closed by a bottom and a second end, opposite the first, forming a neck delimiting an opening;

(b) a rigid structure inside of which the flexible container is removably fitted, wherein when the flexible container is disposed in the rigid structure, the rigid structure extends substantially over an entire height under the neck of the flexible container;

wherein the flexible container is configured such that, when it is extracted from the rigid structure, a pressure exerted on the flexible container causes deformation of the flexible container and displaces the product towards said opening, and wherein the flexible container returns to a substantially undeformed shape by elastic return forces when said pressure ceases; and wherein the opening is closed by a removable lid, and wherein at least one portion of the lid is substantially in contact with a corresponding portion of the rigid structure when the lid is mounted on the flexible container.

34. An assembly for packaging a product comprising:

(a) a flexible container which contains the product, the container having a first end closed by a bottom and a second end, opposite the first, forming a neck delimiting an opening;

(b) a rigid structure inside of which the flexible container is removably fitted, wherein when the flexible container is disposed in the rigid structure, the rigid structure extends substantially over an entire height under the neck of the flexible container;

wherein the flexible container is configured such that, when it is extracted from the rigid structure, a pressure exerted on the flexible container causes deformation of the flexible container and displaces the product towards said opening, and wherein the flexible container returns to a substantially undeformed shape by elastic return forces when said pressure ceases;

wherein the container includes regions of increased thickness as compared with other regions of said container; and wherein said regions of increased thickness include the bottom of said container.

35. An assembly for packaging a product comprising:

(a) a flexible container which contains the product, the container having a first end closed by a bottom and a second end, opposite the first, forming a neck delimiting an opening;

(b) a rigid structure inside of which the flexible container is removably fitted, wherein when the flexible container is disposed in the rigid structure, the rigid structure extends over at least a portion of the flexible container;

wherein the flexible container is configured such that, when it is extracted from the rigid structure, a pressure exerted on the flexible container causes deformation of the flexible container and displaces the product towards said opening, and wherein the flexible container returns to a substantially undeformed shape by elastic return forces when said pressure ceases; and wherein the container is disposed in the rigid structure such that the container can be removed from the rigid structure in response to relative rotation of the container and the rigid structure.

36. An assembly according to claim 35, further including a lid to close said opening, wherein an outer surface of the neck has a screw thread which can interact with a corresponding screw thread provided on an inner surface of the lid.

37. An assembly according to claim 35, wherein at least a first part of said flexible container has a tapered wall profile, and wherein said first part is disposed inside of said rigid structure when said flexible container is disposed in said rigid structure, and further wherein when said flexible container is disposed inside of said rigid structure a portion of said rigid structure adjacent to said first part has a profile similar to said first part.

38. An assembly for packaging a product comprising:

(a) a container which contains the product, the container including a closed end and a neck delimiting an opening, the container further including flexible wall portions;

(b) a rigid structure which removably receives said container, said rigid structure including rigid wall portions which cover the flexible wall portions of said container when said container is disposed in said rigid structure;

(c) a lid removably mountable on said neck, wherein at least a portion of said lid extends outside of said rigid structure when said container is disposed in said rigid structure;

wherein the container is configured such that, when it is extracted from the rigid structure, a pressure exerted on the flexible wall portions causes deformation of the flexible wall portions and displaces the product towards said opening, and wherein the flexible portions return to a substantially undeformed shape by elastic return forces when said pressure ceases.

39. An assembly according to claim 38, wherein said neck of said container has a diameter substantially smaller than a diameter of said flexible wall portions of said container, and wherein said lid includes a skirt having a diameter at least as large as the diameter of said flexible wall portions.

40. An assembly according to claim 39, wherein said lid is rigid.

41. An assembly according to claim 40, wherein an outer portion of said skirt is adjacent to said rigid structure when said lid is mounted on said neck and said container is disposed in said rigid structure.

42. An assembly according to claim 41, wherein said flexible wall portions of said container have a contour which is the same as a contour of the rigid wall portions of said rigid structure.

43. An assembly according to claim 38, wherein said flexible wall portions of said container have a contour which is the same as a contour of the rigid wall portions of said rigid structure.

44. An assembly according to claim 38, wherein said flexible wall portions of said container form at least part of a side wall of said container, wherein said closed end is a bottom of said container, and wherein said container further includes a shoulder extending from said side wall to said neck, and wherein said rigid structure extends up to a height of said shoulder when said container is disposed in said rigid structure.

45. An assembly according to claim 44, wherein said lid covers said shoulder of said container when said lid is mounted on said neck.

46. An assembly according to claim 38, wherein said product in said container a cosmetic product.

47. An assembly according to claim 38, wherein said container is formed of an elastomeric material.

48. An assembly according to claim 38, wherein said container is formed of a polyolefin.

49. An assembly according to claim 38, wherein an outermost surface of said lid is adjacent to an outermost surface of said rigid structure when said lid is mounted on said neck and said container is disposed in said rigid structure.

50. An assembly according to claim 38, wherein said closed end of said container is a bottom of said container, and wherein the container includes attachment means to removably couple the bottom of the container to a bottom of the rigid structure.

* * * * *